US011061360B2

(12) United States Patent
Kimura

(10) Patent No.: US 11,061,360 B2
(45) Date of Patent: Jul. 13, 2021

(54) IMAGE FORMING APPARATUS

(71) Applicant: SHARP KABUSHIKI KAISHA, Sakai (JP)

(72) Inventor: Satoshi Kimura, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/068,520

(22) Filed: Oct. 12, 2020

(65) Prior Publication Data

US 2021/0116853 A1 Apr. 22, 2021

(30) Foreign Application Priority Data

Oct. 16, 2019 (JP) ..... JP2019-189220

(51) Int. Cl.
*G03G 15/04* (2006.01)
*G03G 21/16* (2006.01)

(52) U.S. Cl.
CPC ..... *G03G 21/1652* (2013.01); *G03G 21/1676* (2013.01)

(58) Field of Classification Search
CPC ..... G03G 15/80; G03G 21/1652; G03G 21/1676; G03G 2221/166
USPC ..... 399/111, 119, 120, 252, 258, 262
See application file for complete search history.

(56) References Cited

U.S. PATENT DOCUMENTS 7,953,339 B2 * 5/2011 Fukamachi ..... G03G 15/0855 399/90
8,005,392 B2 * 8/2011 Ishii ..... G03G 15/0865 399/90
2012/0200871 A1 8/2012 Takahashi et al.

FOREIGN PATENT DOCUMENTS

JP 2018-180558 A 11/2018

* cited by examiner

*Primary Examiner* — Hoan H Tran
(74) *Attorney, Agent, or Firm* — ScienBiziP, P.C.

(57) ABSTRACT

An image forming apparatus includes a developing unit attachable to and detachable from an apparatus main body. A terminal holding member that holds a main body-side terminal is provided to be movable in a direction intersecting an attaching direction of the developing unit. The developing unit and the terminal holding member are provided with a protrusion and an opening which are fitted to each other in accordance with an attaching operation. If the protrusion and the opening are fitted, the terminal holding member is moved in a in a direction approaching the developing unit to bring the unit-side terminal and the main body-side terminal into contact with each other, so that the terminal holding member is positioned and fixed to the developing unit.

7 Claims, 16 Drawing Sheets

IMAGE FORMING APPARATUS

BACKGROUND OF THE INVENTION

Field of the Invention

The present invention relates to an image forming apparatus, and in particular, for example, an image forming apparatus which includes an attaching and detaching unit attachable to and detachable from an apparatus main body and in which a unit-side terminal and a main body-side terminal contact each other to be electrically connected when the attaching and detaching unit is attached to the apparatus main body.

Description of the Background Art

An example of a conventional image forming apparatus is disclosed in Japanese Unexamined Patent Application Publication No. 2018-180558 (hereinafter, Patent Document 1). The image forming apparatus disclosed in Patent Document 1 includes a detachable device (attaching and detaching unit) attachable to and detachable from an apparatus main body. In the detachable device, a holder that holds an information storage device is installed. The information storage device is provided with a substrate on which an information storage and a plurality of terminals are held. The substrate also includes a positioning notch that engages with a positioning protrusion provided on the apparatus main body to position the plurality of terminals. The holder holds the information storage device so that the information storage device can be moved on a virtual plane intersecting with an attaching and detaching direction of the detachable device with respect to the apparatus main body.

In the technique of Patent Document 1, unit-side terminals and main body-side terminals contact each other in the same direction as a moving direction of the attaching and detaching unit, however the positioning of the attaching and detaching unit in the moving direction is likely to be incomplete, which may result in poor contact between the unit-side terminals and the main body-side terminals.

Therefore, a main object of the present invention is to provide a novel image forming apparatus.

Another object of the present invention is to provide an image forming apparatus capable of preventing poor contact between a unit-side terminal and a main body-side terminal.

SUMMARY OF THE INVENTION

A first aspect of the present invention is an image forming apparatus including an attaching and detaching unit attachable to and detachable from an apparatus main body, the image forming apparatus including a unit-side terminal provided in the attaching and detaching unit, a main body-side terminal that is provided in the apparatus main body and contacts the unit-side terminal when the attaching and detaching unit is attached to the apparatus main body, a terminal holding member that is provided in the apparatus main body and holds the main body-side terminal, a unit-side fitter provided in the attaching and detaching unit; and a main body-side fitter that is provided in the terminal holding member and is fitted to the unit-side fitter in accordance with an operation for attaching the attaching and detaching unit. The terminal holding member is provided to be movable in a predetermined direction intersecting with an attaching direction of the attaching and detaching unit, and the unit-side fitter and the main body-side fitter are fitted to each other to move the terminal holding member in the predetermined direction and in a direction approaching the attaching and detaching unit so that the terminal holding member is positioned and fixed in at least the predetermined direction with respect to the attaching and detaching unit in a state where the unit-side terminal and the main body-side terminal contact each other.

In the first aspect of the present invention, the image forming apparatus includes the attaching and detaching unit such as a developing unit attachable to and detachable from the apparatus main body. The attaching and detaching unit and the apparatus main body are provided with the unit-side terminal and the main body-side terminal, respectively, which contact each other when the attaching and detaching unit is attached to the apparatus main body. The terminal holding member that holds the main body-side terminal is not fixed to the apparatus main body, but is provided in the apparatus main body to be movable in the predetermined direction intersecting with the attaching direction of the attaching and detaching unit. The developing unit and the terminal holding member are provided with a unit-side fitter and the main body-side fitter, respectively, which are fitted to each other in accordance with the operation for attaching the developing unit. The unit-side fitter and the main body-side fitter are fitted to each other to move the terminal holding member and the main body-side terminal in the predetermined direction intersecting with the attaching direction of the attaching and detaching unit and in the direction approaching the attaching and detaching unit so that the unit-side terminal and the main body-side terminal contact each other. As a result, the main body-side terminal and the unit-side terminal contact each other in the predetermined direction intersecting with the attaching direction of the attaching and detaching unit. In the state where the unit-side terminal and the main body-side terminal contact each other, the unit-side fitter and the main body-side fitter position and fix the terminal holding member and the main body-side terminal in at least the predetermined direction, which intersects with the attaching and detaching direction of the attaching and detaching unit, with respect to the attaching and detaching unit, that is, in a contact direction of the unit-side terminal and the main body-side terminal.

According to the first aspect of the present invention, the positioning in the contact direction of the unit-side terminal and the main body-side terminal, which is likely to be unstable, can be reliably performed by fitting the unit-side fitter and the main body-side fitter, and thus it is possible to prevent poor contact between the unit-side terminal and the main body-side terminal.

In a second aspect of the present invention according to the first aspect of the present invention, the unit-side fitter and the main body-side fitter also position and fix the terminal holding member in a direction perpendicular to the predetermined direction with respect to the attaching and detaching unit in the state where the unit-side terminal and the main body-side terminal contact each other.

In a third aspect of the present invention according to the first or second aspect of the present invention, the unit-side fitter is a protrusion extending in the attaching direction of the attaching and detaching unit, and the main body-side fitter is an opening which is open in the attaching direction of the attaching and detaching unit and into which the protrusion is fitted.

In a fourth aspect of the present invention according to the third aspect of the present invention, the protrusion includes a guide slope that is formed on a rear side in the attaching direction of the attaching and detaching unit and guides the terminal holding member in a direction approaching the attaching and detaching unit while sliding with respect to the opening, and a restrictor that is formed on a front side in the attaching direction of the attaching and detaching unit with respect to the guide slope and positions and fixes the terminal holding member with respect to the attaching and detaching unit in at least the predetermined direction with the restrictor abutting against the opening.

In a fifth aspect of the present invention according to the third aspect of the present invention, the opening includes a guide slope that is formed on a front side in the attaching direction of the attaching and detaching unit and guides the terminal holding member in a direction approaching the attaching and detaching unit while sliding with respect to the protrusion, and a restrictor that is formed on a rear side in the attaching direction of the attaching and detaching unit with respect to the guide slope and positions and fixes the terminal holding member with respect to the attaching and detaching unit in at least the predetermined direction with the restrictor abutting against the protrusion.

A sixth aspect of the present invention according to any one of the first to fifth aspects of the present invention includes a detent that restricts the terminal holding member from pivoting with respect to the attaching and detaching unit.

A seventh aspect of the present invention according to any one of the first to sixth aspects of the present invention includes an urging member that is provided in the apparatus main body and urges the terminal holding member in the predetermined direction and in a direction away from the attaching and detaching unit.

According to the present invention, the positioning in the contact direction of the unit-side terminal and the main body-side terminal, which is likely to be unstable, can be reliably performed by fitting the unit-side fitter and the main body-side fitter, and thus, it is possible to prevent poor contact between the unit-side terminal and the main body-side terminal.

The above object, other objects, features, and advantages of the present invention will be more apparent from the detailed description of embodiments given below with reference to the drawings.

DESCRIPTION OF THE PREFERRED EMBODIMENTS

First Embodiment

Figure 1:
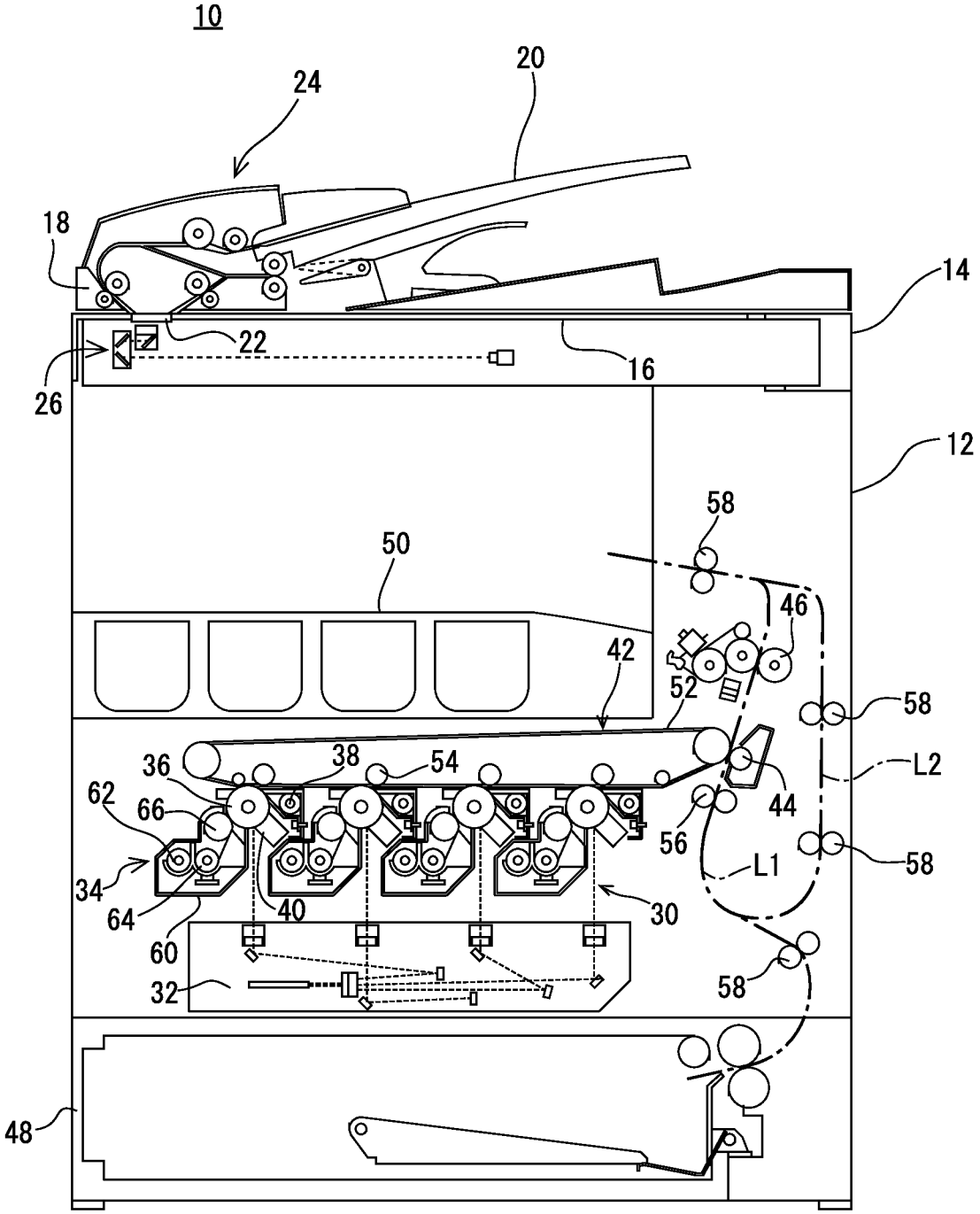
FIG. 1 is a schematic cross-sectional view illustrating an internal structure of an image forming apparatus according to a first embodiment of the present invention.

Referring to FIG. 1, an image forming apparatus 10, which is an embodiment of the present invention, is a multifunction peripheral (MFP) having a copying function, a printer function, a scanner function, a facsimile function, and the like, and forms a multicolor or monochromatic image on a sheet (recording medium) by an electrophotographic system. As described in detail below, the image forming apparatus 10 includes a developing unit 34 being an example of an attaching and detaching unit. The developing unit 34 is attachable to and detachable from (insertable into and drawable from) an apparatus main body 12 of the image forming apparatus 10 in the longitudinal direction. When the developing unit 34 is attached to the apparatus main body 12, a unit-side terminal 70 and a main body-side terminal 108 contact each other in a direction intersecting with the attaching direction of the developing unit 34.

First, a basic configuration of the image forming apparatus 10 will be generally described. In the first embodiment, a front-rear direction (depth direction) of the image forming apparatus 10 and components thereof is defined by assuming that a surface facing a standing position of a user operating the image forming apparatus 10, that is, a surface at a side on which an operation panel is provided as a front surface (front). A left-right direction (lateral direction) of the image forming apparatus 10 and the components thereof is defined based on a state in which the image forming apparatus 10 is viewed from a user.

As illustrated in FIG. 1, the image forming apparatus 10 includes: the apparatus main body 12 including an image former 30; and an image reading device 14 placed above the apparatus main body 12.

The image reading device 14 includes a document platen 16 formed of a transparent material. A document pressing cover 18 is attached above the document platen 16 through a hinge or the like to be freely opened and closed. The document pressing cover 18 is provided with an automatic document feeder (ADF) 24 that automatically feeds documents placed on a document set tray 20 one by one to an image reading position 22. Although illustration is omitted, on the front side of the document platen 16, an operation processor such as a touch panel and operation buttons for receiving an input operation such as a print instruction from a user is provided.

In the image reading device 14, an image reader 26 including a light source, a plurality of mirrors, imaging lens, a line sensor, and the like is built. The image reader 26 exposes a document surface with light from the light source, and guides reflected light reflected from the document surface to the imaging lens by the plurality of mirrors. The reflected light is imaged on a light receiving element of the line sensor by the imaging lens. The line sensor detects luminance and chromaticity of the reflected light imaged on the light receiving element to generate image data based on an image on the document surface. A charge coupled device (CCD), a contact image sensor (CIS), or the like is employed for the line sensor.

In the apparatus main body 12, a controller (not illustrated) including a CPU, a memory, and the like, the image former 30, and the like are built. The controller transmits a control signal to each component of the image forming apparatus 10, based on an input operation to the operation processor such as the touch panel, or the like, and causes the image forming apparatus 10 to execute various operations.

The image former 30 includes an exposure unit 32, the developing unit 34, a photoreceptor drum 36, a cleaner 38, a charger 40, an intermediate transfer belt system 42, a transfer roller 44, a fixer 46, and the like, and forms an image on a sheet conveyed from a sheet feed tray 48 or the like, and discharges the sheet on which an image is formed to a sheet discharge tray 50. Image data read by the image reader 26, image data transmitted from an external computer, or the like is used as image data to form an image on the sheet.

It is noted that image data processed in the image forming apparatus 10 corresponds to a color image of four colors including black (K), cyan (C), magenta (M), and yellow (Y). Thus, the developing unit 34 includes four developing units 34, the photoreceptor drum 36 includes four photoreceptor drums 36, the cleaner 38 includes four cleaners 38, and the charger 40 includes four chargers 40, to form four types of latent images corresponding to each of the colors, and the four developing units 34, photoreceptor drums 36, cleaners 38, and chargers 40 constitute four image stations. The four image stations are arranged in a line in the horizontal direction along the traveling direction of the surface of an intermediate transfer belt 52. The photoreceptor drum 36, the cleaner 38, and the charger 40 are unitized, and these constitute a photoreceptor. Each of the developing unit 34 and the photoreceptor is individually attachable to and detachable from the front side of the apparatus main body 12. However, the developing unit 34 and the photoreceptor may be attached to and detached from the apparatus main body 12 in an integrated state.

The photoreceptor drum 36 is an electrostatic latent image carrier having a photosensitive layer formed on the surface of a conductive cylindrical base body, and is rotatable about its axis by a drive device (not illustrated). The charger 40 is a member that charges the surface of the photoreceptor drum 36 to a predetermined potential. The exposure unit 32 is configured as a laser scanning unit (LSU) including a laser emitter, a reflection mirror, and the like, and exposes the charged surface of the photoreceptor drum 36 with light to form an electrostatic latent image corresponding to image data on the surface of the photoreceptor drum 36. The cleaner 38 removes and collects residual toner on the surface of the photoreceptor drum 36 after a toner image is transferred to the intermediate transfer belt 52.

The developing unit 34 visualizes an electrostatic latent image formed on the surface of the photoreceptor drum 36 with toner of four colors (YMCK) (forms a toner image), and includes a developing roller 66 for supplying toner to the photoreceptor drum 36, and the like. In a development housing 60 of the developing unit 34, a developing agent (two-component developing agent) composed of toner and carrier is contained, and the toner contained in the developing agent is supplied to the photoreceptor drum 36 via the developing roller 66. The specific configuration of the developing unit 34 will be described below.

The intermediate transfer belt system 42 includes the intermediate transfer belt 52, a driving roller, a driven roller, four intermediate transfer rollers 54, and the like, and is arranged above the photoreceptor drum 36. The intermediate transfer belt 52 is provided to contact each of the photoreceptor drums 36. A toner image of each of the colors formed on each of the photoreceptor drums 36 is sequentially superposed on and transferred to the intermediate transfer belt 52 by using the intermediate transfer rollers 54, so that a multicolor toner image is formed on the intermediate transfer belt 52. The transfer roller 44 is arranged in the vicinity of the driving roller, and a sheet passes through a nip area between the intermediate transfer belt 52 and the transfer roller 44, so that the toner image formed on the intermediate transfer belt 52 is transferred onto the sheet.

The fixer 46 includes a heat roller and a pressure roller, and is arranged above the transfer roller 44. The heat roller is set to have a predetermined fixing temperature, and the toner image transferred onto the sheet is melted, mixed, and pressed when the sheet passes through the nip area between the heat roller and the pressure roller, so that the toner image is thermally fixed to the sheet.

A first sheet conveyance path L1 is formed in the apparatus main body 12 to feed a sheet from the sheet feed tray 48 or the like to the sheet discharge tray 50 via a paper stop roller 56, the transfer roller 44, and the fixer 46. Further, a second sheet conveyance path L2 is formed to, when duplex printing is performed on a sheet, return the sheet that has been subjected to single-sided printing and then passed through the fixer 46 to the first sheet conveyance path L1 on the upstream side of the transfer roller 44 in a sheet conveyance direction. In the first sheet conveyance path L1 and the second sheet conveyance path L2, a plurality of conveyance rollers 58 are provided, as appropriate, that applies a propelling force to a sheet in an auxiliary manner.

Figure 2:
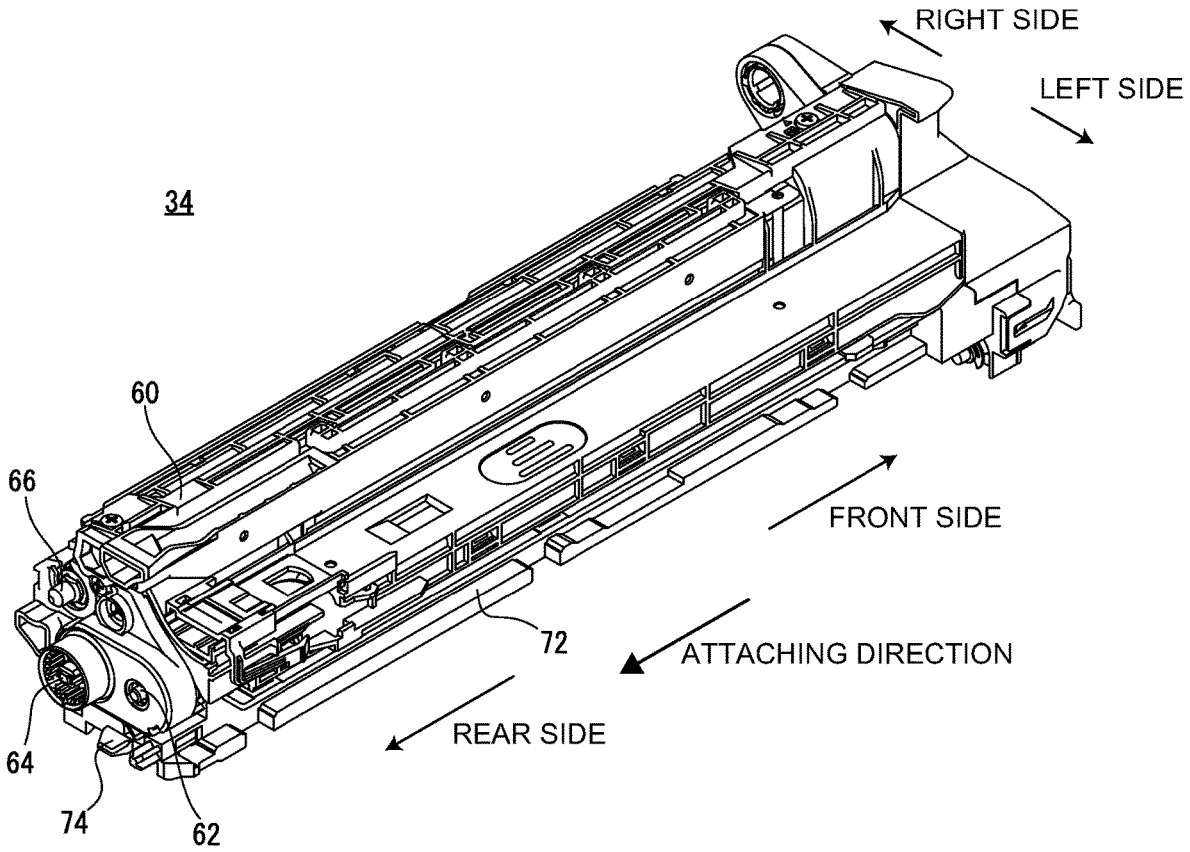
FIG. 2 is a perspective view illustrating a developing unit included in the image forming apparatus.
Figure 3:
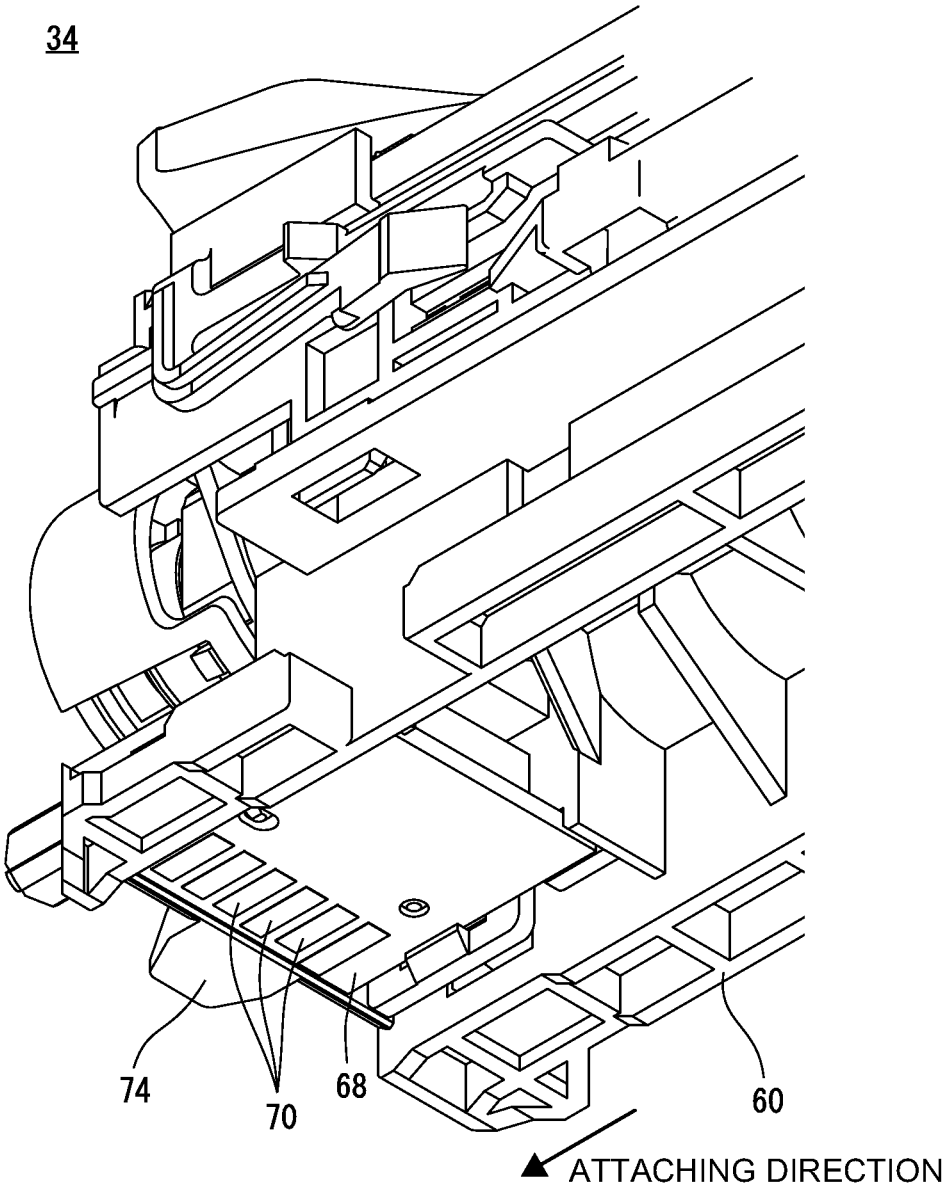
FIG. 3 is a perspective view illustrating a rear end of the developing unit as viewed obliquely from below.

Next, the configuration of the developing unit 34 will be described with reference to FIGS. 2 and 3 together with FIG. 1. As illustrated in FIGS. 1 to 3, the developing unit 34 includes a first conveyance member 62, a second conveyance member 64, the developing roller 66, a doctor blade (not illustrated), and the like, which are integrally held in a predetermined arrangement fashion by the development housing 60.

Specifically, inside the development housing 60, the first conveyance member 62 and the second conveyance member 64 are provided so that the respective rotation axes of the first conveyance member 62 and the second conveyance member 64 are parallel to each other, and a developing agent in which toner and carrier are mixed is contained. The first conveyance member 62 and the second conveyance member 64 are auger screws in which spiral blades are formed on the outer peripheral surface of a cylindrical rotation shaft (screw shaft). The first conveyance member 62 and the second conveyance member 64 circulate the developing agent in a predetermined direction in the development housing 60 by conveying the developing agent with being stirred.

In the development housing 60, the developing roller 66 is arranged above the second conveyance member 64. The developing roller 66 is a magnet roller functioning as a developing agent carrier, and is arranged at a position in the vicinity of the photoreceptor drum 36 in the horizontal direction so that the rotation axes of the developing roller 66 and the photoreceptor drum 36 are parallel to each other and the outer peripheral surfaces thereof are close to each other. The developing roller 66 carries the developing agent in the development housing 60 on the surface, and supplies toner contained in the carried developing agent to the surface of the photoreceptor drum 36. As a result, an electrostatic latent image formed on the surface of the photoreceptor drum 36 is visualized.

The development housing 60 is provided with the doctor blade to have a predetermined gap with respect to the surface of the developing roller 66. The doctor blade is a plate-shaped member extending in the axial direction of the developing roller 66. The doctor blade regulates an amount of the developing agent carried on the developing roller 66 to a predetermined amount.

A rectangular plate-shaped substrate 68 is provided on the lower surface of the development housing 60 at a rear end of the developing unit 34 in the attaching direction. The substrate 68 is arranged parallel to the attaching direction of the developing unit 34 (horizontally in the first embodiment). A memory (not illustrated) for storing information is mounted on the substrate 68, and a plurality of unit-side terminals 70 are provided on the lower surface of the substrate 68 (and thus, the lower surface of the developing unit 34) to be exposed to the outside. The unit-side terminals 70 are a portion that contacts and is electrically connected to main body-side terminals 108, which will be described below when the developing unit 34 is attached to the apparatus main body 12. Electrically connecting the unit-side terminals 70 and the main body-side terminals 108 allows information exchange (communication) between the substrate 68 of the developing unit 34 and the controller of the apparatus main body 12. In the first embodiment, the unit-side terminals 70 are each formed in a rectangular plate shape extending in the attaching and detaching direction (front-rear direction) of the developing unit 34, and are arranged side by side at predetermined intervals in the width direction (left-right direction) of the developing unit 34.

The development housing 60 is provided with a toner concentration sensor (not illustrated) for detecting a toner concentration in the development housing 60. The toner concentration sensor is connected to the substrate 68. Information detected by the toner concentration sensor is temporarily stored in the memory of the substrate 68 and then transmitted to the controller of the apparatus main body 12 via the unit-side terminals 70 and the main body-side terminals 108. The controller of the apparatus main body 12 controls replenishment of the developing agent from a toner cartridge into the development housing 60, based on the information detected by the toner concentration sensor.

Such a developing unit 34 is detachably attached to a developing unit accommodator 100 (see FIG. 4) provided in the apparatus main body 12 from the front side of the apparatus main body 12.

An insertion guide 72 is provided in the development housing 60 of the developing unit 34 and the developing unit accommodator 100 of the apparatus main body 12. The insertion guide 72 includes a guide groove, a guide protrusion, and the like that are slidably fitted, and guides the developing unit 34 to an image forming position in accordance with the attaching operation (inserting operation) of the developing unit 34. In the first embodiment, the developing unit 34 is guided to be moved by the insertion guide 72 in a state of being inclined from a normal posture (position) of the developing unit 34 and at a position shifted downward from the normal posture from the start of attaching to the developing unit accommodator 100 until immediately before completion of the attaching. In a period between the time immediately before the completion of the attaching and the completion of the attaching, the developing unit 34 is pivoted while being lifted and brought closer to the photoreceptor drum 36 in accordance with the attaching operation, and then is positioned in the normal posture such that the outer peripheral surface of the developing roller 66 is close to the outer peripheral surface of the photoreceptor drum 36.

In other words, the developing unit 34 is positioned at the image forming position only by the operation for attaching the developing unit 34 to the developing unit accommodator 100, and moves in the attaching direction while pivoting in the operation immediately before the completion of the attaching operation. Refer to Japanese Unexamined Patent Application Publication No. 2017-58485 by the applicant of this application for a specific example of such an insertion guide.

Figure 4:
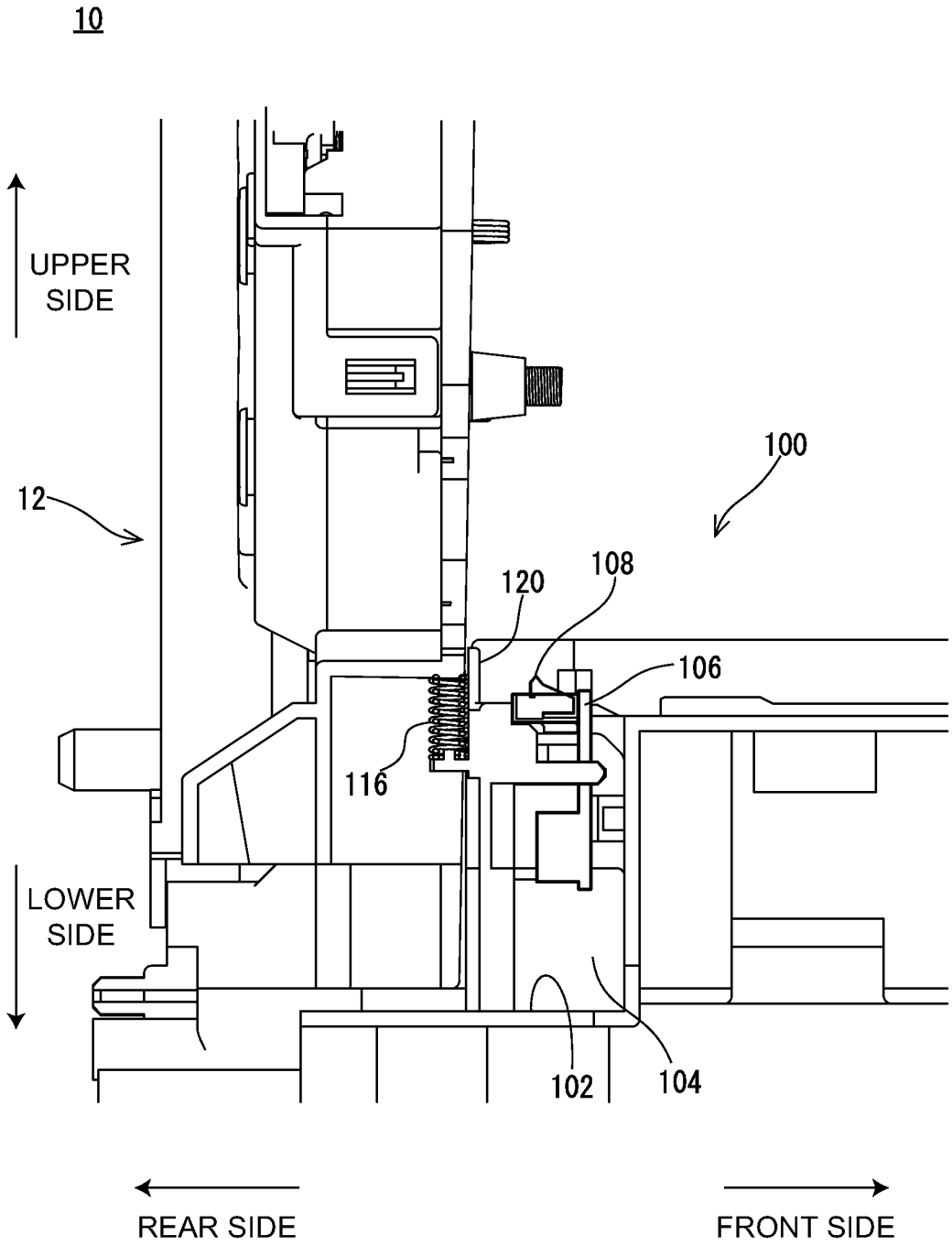
FIG. 4 is a cross-sectional view illustrating a state of a terminal holding member before the developing unit is attached.

On the other hand, as illustrated in FIG. 4, the developing unit accommodator 100 in which the developing unit 34 is accommodated is formed in the apparatus main body 12. The plurality of main body-side terminals 108 are provided on the bottom of the developing unit accommodator 100 to be exposed at the rear end of the developing unit 34 in the attaching direction (i.e., the rear of the apparatus main body 12). The main body-side terminals 108 are a portion that contacts the unit-side terminals 70 and is electrically connected when the developing unit 34 is attached to the apparatus main body 12. In the first embodiment, the main body-side terminals 108 are each formed in an elastically deformable leaf spring shape, each extend in the attaching and detaching direction of the developing unit 34, and are arranged side by side at predetermined intervals in the width direction of the developing unit 34. When a load is applied to the main body-side terminals 108 from above, the body-side terminals 108 are elastically deformed to be pushed down. When the load from above is released, the main body-side terminals 108 return to the original state by the elastic restoring force.

The unit-side terminals 70 and the main body-side terminals 108 are required to surely contact each other when the developing unit 34 is attached to the apparatus main body 12. However, in the conventional techniques, positioning the unit-side terminals and the main body-side terminals in the contact direction is likely to be unstable, which may cause a risk of poor contact.

Therefore, the first embodiment adopts a configuration in which the main body-side terminals 108 get close to and contact the unit-side terminals 70 from below in accordance with the operation for attaching the developing unit 34, and in this contact state, the main body-side terminals 108 are positioned and fixed with respect to the developing unit 34, so that the unit-side terminals 70 and the main body-side terminals 108 surely contact each other. Hereinafter, a terminal contact structure for bringing the unit-side terminals 70 and the main body-side terminals 108 into contact with each other will be specifically described.

Figure 5:
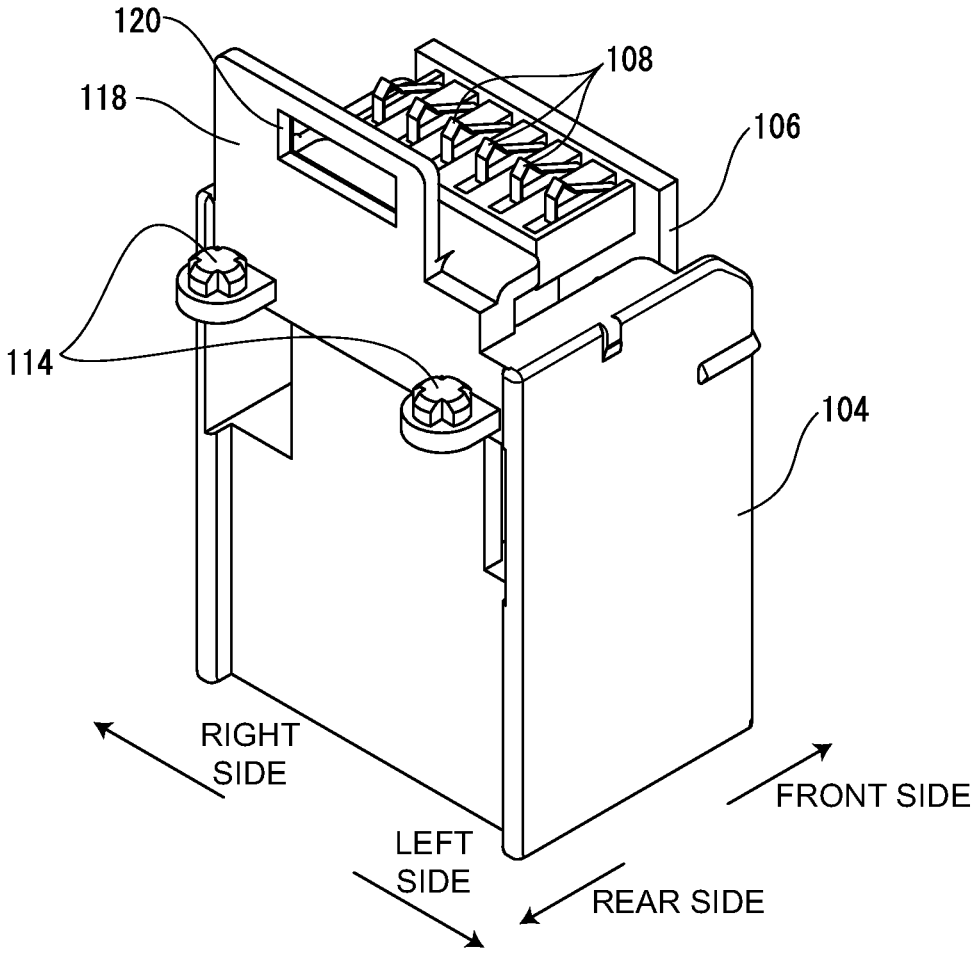
FIG. 5 is a perspective view illustrating the terminal holding member included in the image forming apparatus.
Figure 6:
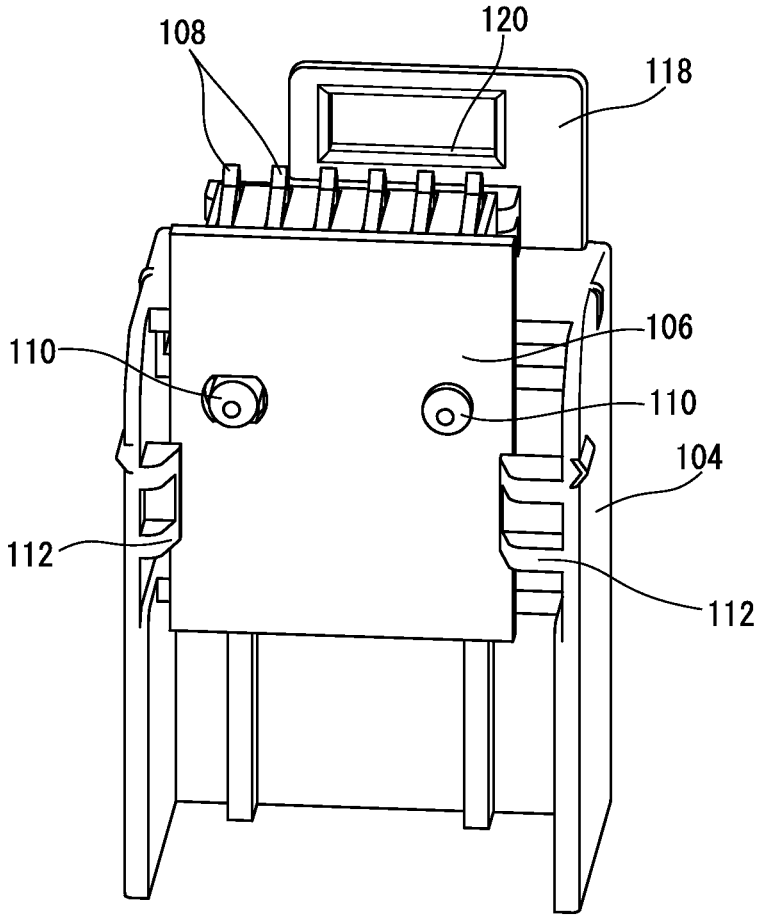
FIG. 6 is a perspective view illustrating a front surface side of the terminal holding member.

Referring to FIGS. 5 and 6 together with FIG. 4, a holding member accommodator 102 communicating with the developing unit accommodator 100 is formed below the rear end of the developing unit accommodator 100 in the apparatus main body 12. A box-shaped terminal holding member 104 is provided in the holding member accommodator 102 to be movable in the up-down direction (which is an example of a predetermined direction intersecting with the attaching direction of the developing unit 34). Specifically, the terminal holding member 104 is not fixed to the apparatus main body 12 but slides with a slight play (e.g., 0.5 to 1.0 mm) with respect to the holding member accommodator 102. However, it is preferable that a play in the front-rear direction being the attaching direction of the developing unit 34 is as small as possible.

On the terminal holding member 104, a contact substrate 106 having the main body-side terminals 108 are held in a positioned state. In other words, the main body-side terminals 108 are held in a state of being positioned by the terminal holding member 104 to move up and down as the terminal holding member 104 moves up and down (moves). Specifically, the contact substrate 106 is arranged on the front side of the terminal holding member 104 to extend in the up-down direction, and is positioned and fixed by an engagement such as protrusions 110 and claws 112 formed on the terminal holding member 104. The main body-side terminals 108 are provided so that tip ends of the main body-side terminals 108 are free ends and base ends thereof are fixed to the contact substrate 106 and are elastically deformable in the up-down direction to project from the upper surface of the terminal holding member 104.

The terminal holding member 104 is provided with urging member attachers 114 on the back side. On the upper surface of each of the urging member attachers 114, a compression coil spring 116 being an example of an urging member is provided to extend in the up-down direction between the urging member attacher 114 and the apparatus main body 12. The terminal holding member 104 is held in the holding member accommodator 102 in a state of being urged downward (in a predetermined direction intersecting with the attaching direction of the developing unit 34 and in a direction away from the developing unit 34) by the compression coil spring 116. As a result, the terminal holding member 104 is held in the holding member accommodator 102 in a state of being pressed against the bottom surface of the holding member accommodator 102 by the compression coil spring 116 before the developing unit 34 is attached to the developing unit accommodator 100. This stabilizes a position of the terminal holding member 104 before the attaching of the developing unit 34.

In the first embodiment, the terminal holding member 104 includes a rectangular plate-shaped wall 118 protruding upward at a rear end of the upper surface of the terminal holding member 104, and an opening 120 being an example of a main body-side fitter is formed in the wall 118. The opening 120 is a rectangular hole to fit to a protrusion 74, which will be described below, in association with the operation for attaching the developing unit 34, and is open in the attaching direction of the developing unit 34.

Figure 7:
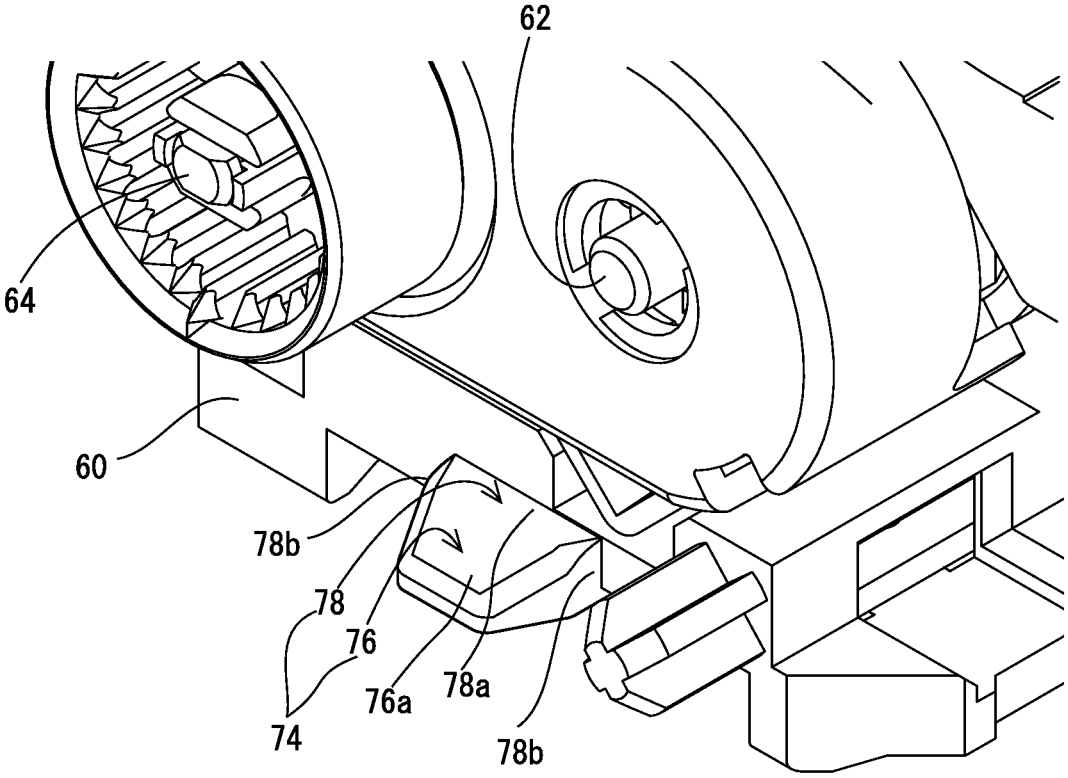
FIG. 7 is an enlarged perspective view illustrating a rear end of the developing unit.

On the other hand, as illustrated in FIGS. 2 and 7, the developing unit 34 is provided with the protrusion 74 being an example of a unit-side fitter. In the first embodiment, the protrusion 74 is formed on a lower portion of the rear end surface of the development housing 60 to protrude rearward (in the attaching direction of the developing unit 34). The protrusion 74 includes a guide slope **76*a* at a tip end 76 of the protrusion 74 (a rear side portion of the developing unit 34 in the attaching direction), and restrictors 78*a* and 78*b* at a base end 78 of the protrusion 74 (a front side portion of the developing unit 34** in the attaching direction).

Specifically, the protrusion 74 has a rectangular parallelepiped shape at the base end 78, and has a tapered shape being gradually thinner toward the rear at the tip end 76. In other words, the upper surface at the tip end 76 of the protrusion 74 is an inclined surface having a downward slope toward the rear, and the guide slope **76*a* is formed on the upper surface. The guide slope 76*a* guides the terminal holding member 104 in a direction approaching the developing unit 34 while sliding with respect to an upper edge of the opening 120 in the middle of fitting the protrusion 74 and the opening 120. The right surface and the left surface of the tip end 76 of the protrusion 74 are inclined surfaces being inclined in a direction approaching each other toward the rear. This makes it easy to fit the protrusion 74 into the opening 120**.

The upper surface of the base end 78 of the protrusion 74 is a flat surface extending in the horizontal direction, and the first restrictor **78*a* is formed on upper surface. The first restrictor 78*a* is a portion that positions and fixes the terminal holding member 104 with respect to the developing unit 34 in the up-down direction (in the contact direction between the unit-side terminal 70 and the main body-side terminal 108) with the portion abutting against the upper edge of the opening 120 when the protrusion 74 and the opening 120 are fitted to each other. The right surface and the left surface of the base end 78 of the protrusion 74 are flat surfaces extending in the vertical direction, and the second restrictors 78*b* are formed on the right surface and the left surface. The second restrictors 78*b* are a portion that positions and fixes the terminal holding member 104 with respect to the developing unit 34 in the left-right direction with the portion abutting against each of the right and left edges of the opening 120 when the protrusion 74 and the opening 120** are fitted to each other.

The base end 78 of the protrusion 74 has a rectangular parallelepiped shape, and thus, the base end 78 also functions as a detent that restricts the rotation of the terminal holding member 104 with respect to the developing unit 34 when the base end 78 is fitted into the rectangular opening 120.

Next, with reference to FIGS. 4 and 8 to 10, an operation when the developing unit 34 is attached to the developing unit accommodator 100 of the apparatus main body 12 will be described.

Figure 8:
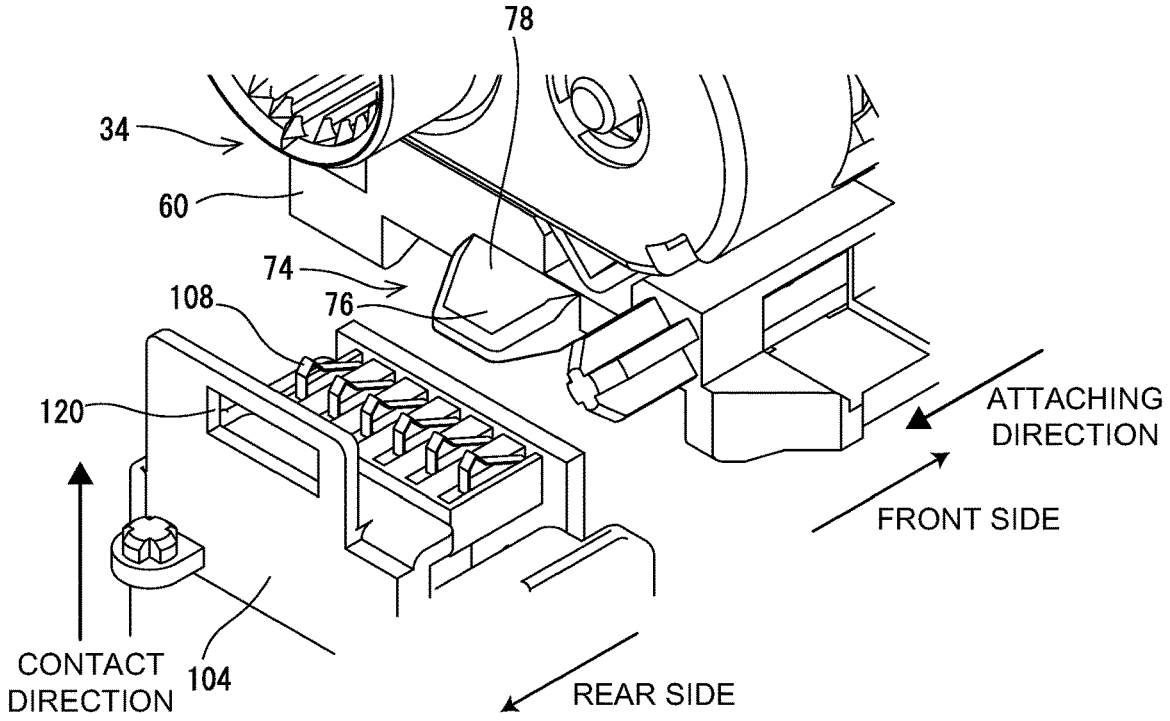
FIG. 8 is a perspective view illustrating how the developing unit is attached.

As illustrated in FIGS. 4 and 8, the terminal holding member 104 is urged downward by the compression coil spring 116 before the developing unit 34 is attached to the developing unit accommodator 100, so that the terminal holding member 104 is placed on the bottom surface of the holding member accommodator 102. The state of the terminal holding member 104 being placed on the bottom surface of the holding member accommodator 102 is maintained from the start of operation for attaching the developing unit 34 to the developing unit accommodator 100 until immediately before the completion of the attaching.

When the attaching operation further proceeds from the state illustrated in FIG. 8 and then the operation for attaching the developing unit 34 is about to be completed, the protrusion 74 and the opening 120 start to be fitted to each other. In other words, the protrusion 74 and the opening 120 are gradually fitted to each other in accordance with the operation for attaching the developing unit 34. When the fitting operation of the protrusion 74 and the opening 120 starts, the guide slope **76*a* of the protrusion 74 abuts against the upper edge of the opening 120, and as the fitting operation proceeds, the upper edge of the opening 120 moves to run on the guide slope 76***a*. Along with this, the terminal holding member 104 and the main body-side terminals 108 are pulled upward, that is, move in the direction approaching the developing unit 34, and then the unit-side terminals 70 and the main body-side terminals 108 contact each other. As a result, the unit-side terminals 70 and the main body-side terminals 108 contact each other in the up-down direction being a direction intersecting with the attaching direction of the developing unit 34.

Figure 9:
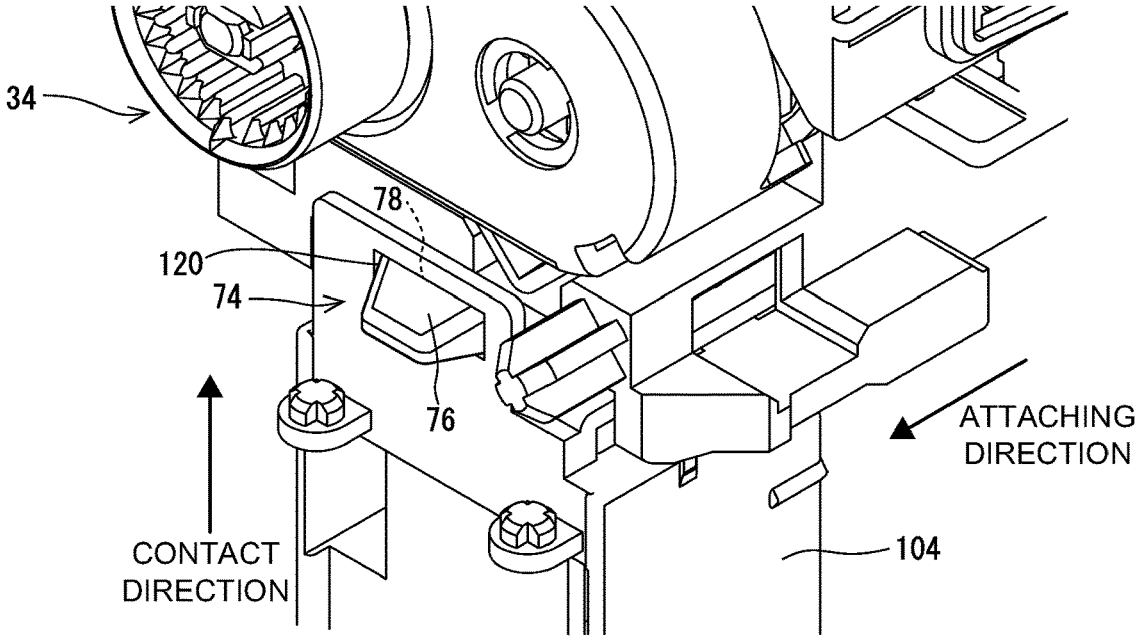
FIG. 9 is a perspective view illustrating a state when the attaching of the developing unit is completed.
Figure 10:
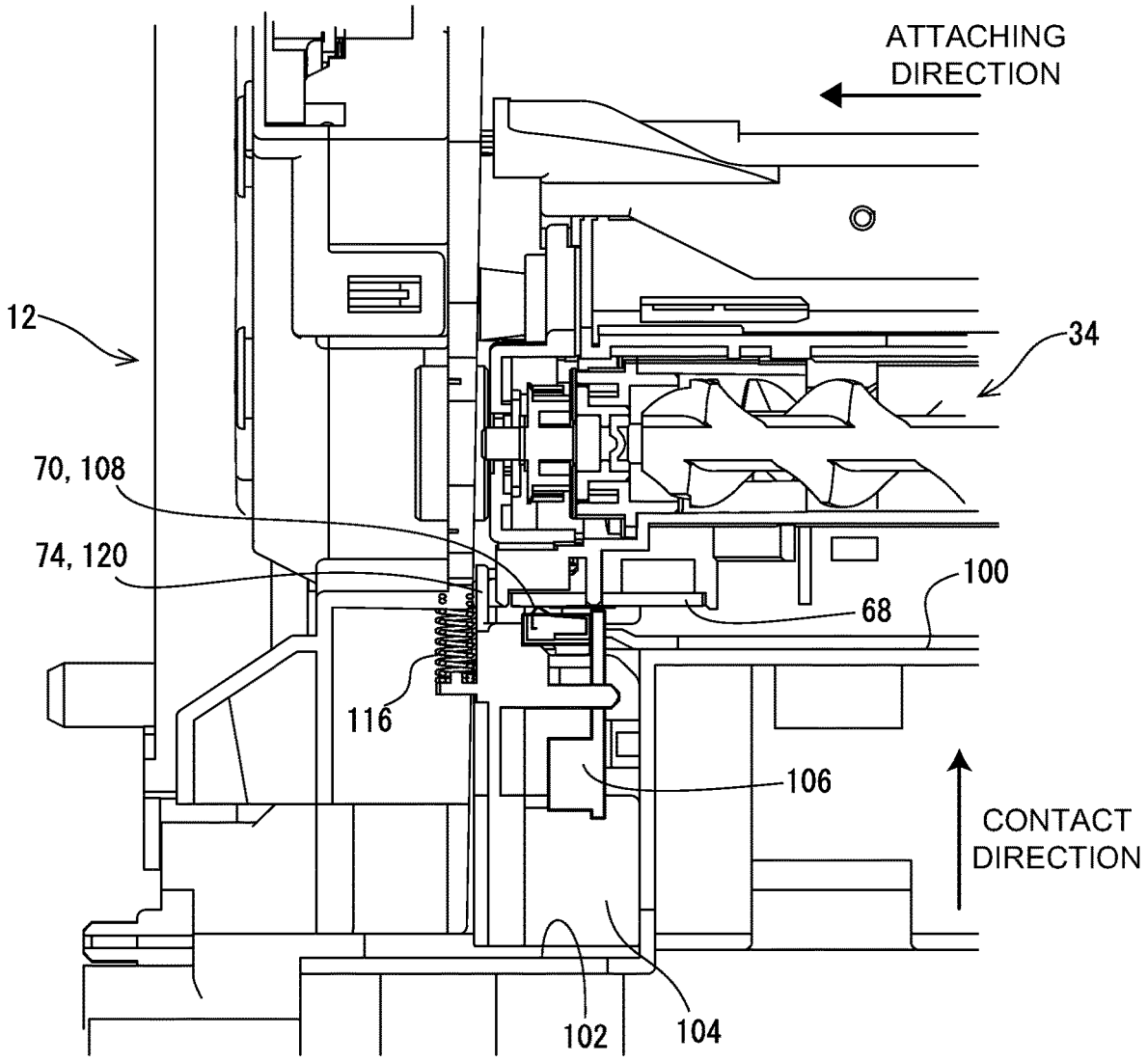
FIG. 10 is a cross-sectional view illustrating the state when the attaching of the developing unit is completed.

Then, as illustrated in FIGS. 9 and 10, when the operation for attaching the developing unit 34 is completed, the base end 78 of the protrusion 74 is fitted into the opening 120. As a result, the terminal holding member 104 and the main body-side terminals 108 are positioned and fixed to the developing unit 34 in a state where the unit-side terminals 70 and the main body-side terminals 108 contact each other with a predetermined pressure.

Specifically, the first restrictor 78*a* of the protrusion 74 and the upper edge of the opening 120 abut against each other, so that the terminal holding member 104 and the main body-side terminals 108 are positioned and fixed in the up-down direction with respect to the developing unit 34. In other words, the positioning of the unit-side terminals 70 and the main body-side terminals 108 in the contact direction is defined by the fitting of the protrusion 74 and the opening 120. The second restrictors 78*b* of the protrusion 74 abut against each of the right edge and the left edge of the opening 120, so that the terminal holding member 104 and the main body-side terminals 108 are positioned and fixed in the left-right direction with respect to the developing unit 34. Thus, the position of the terminal holding member 104 with respect to the developing unit 34 is established by the surface, and thus, it is possible to firmly hold the terminal holding member 104 with respect to the developing unit 34.

It is noted that when the developing unit 34 is detached (disengaged) from the developing unit accommodator 100, the fitting of the protrusion 74 and the opening 120 is released along with the disengaging operation. Then, the terminal holding member 104 returns to the original state in which the terminal holding member 104 is placed on the bottom surface of the holding member accommodator 102, due to the own weight of the terminal holding member 104 and an urging force from the compression coil spring 116.

As described above, according to the first embodiment, the positioning of the unit-side terminals 70 and the main body-side terminals 108 in the contact direction, which is likely to be unstable, can be ensured by the fitting of the protrusion 74 and the opening 120, and thus, it is possible to appropriately prevent poor contact between the unit-side terminals 70 and the main body-side terminals 108.

Particularly, it is possible to surely bring the unit-side terminals 70 and the main body-side terminals 108 into contact with each other even in the developing unit 34 pivoting while being lifted in the operation immediately before the attaching operation is completed, that is, moving in a direction away from the main body-side terminals 108 in the operation immediately before the unit-side terminals 70 and the main body-side terminals 108 contact each other.

Only performing the operation for attaching the developing unit 34 brings the unit-side terminals 70 and the main body-side terminals 108 into contact with each other, and thus, an operation load on a user does not increase. In addition, it is possible to inexpensively manufacture the image forming apparatus 10 as compared with a case of using a drawer connector.

Furthermore, the main body-side terminals 108 are positioned and fixed to the developing unit 34, and thus, even if the developing unit 34 vibrates during use, the unit-side terminals 70 and the main body-side terminals 108 vibrate in the same manner, which causes no friction between the terminals. Therefore, abrasion of the terminals can be prevented and poor contact between the terminals can also be appropriately prevented.

Second Embodiment

Next, the image forming apparatus 10 according to a second embodiment of the present invention will be described. In the second embodiment, the configurations of a unit-side fitter and a main body-side fitter are different from those of the above-described first embodiment. The other parts are the same, and thus, the parts common to those in the above-described first embodiment are designated by the same reference numerals, and duplicated description will be omitted or simplified. The duplicated description being omitted or simplified is also applied to third to fifth embodiments to be described below.

Figure 11:
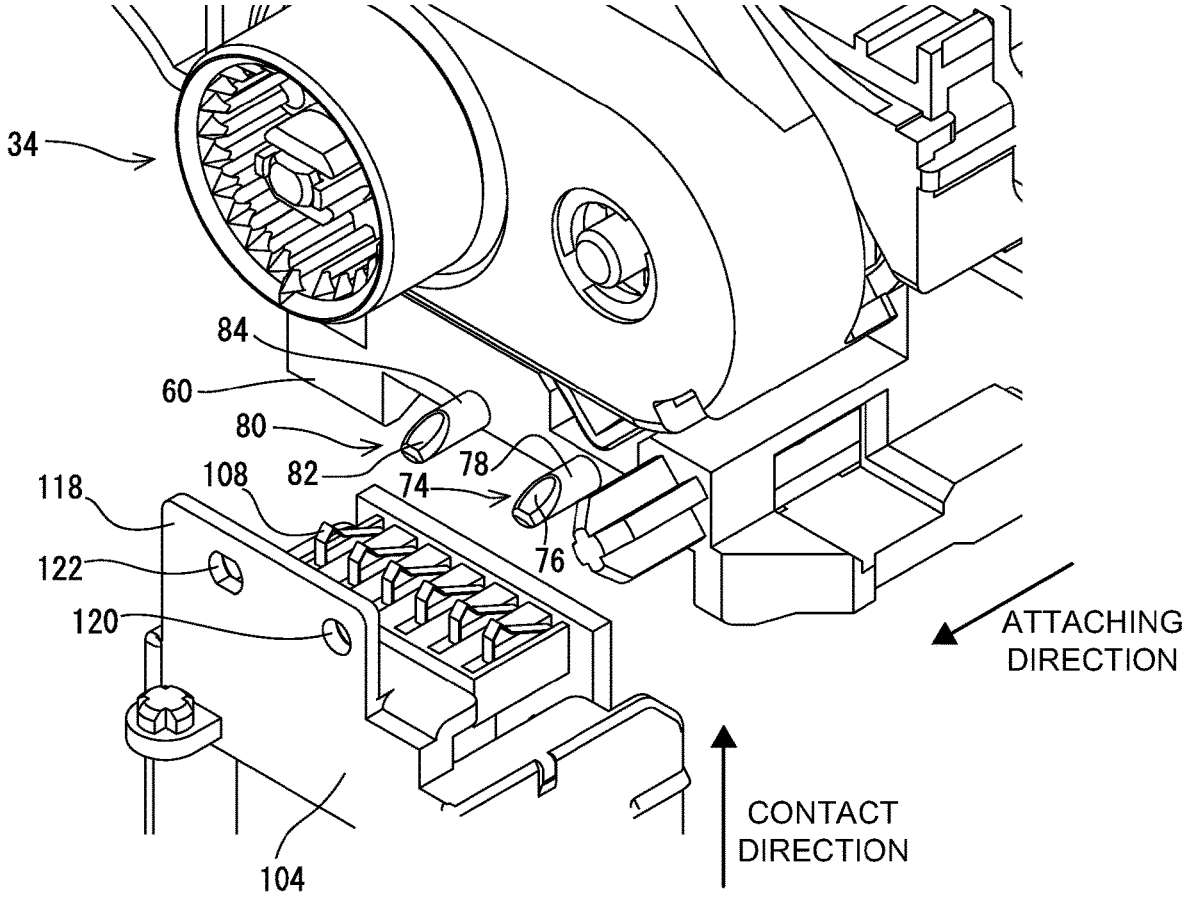
FIG. 11 is a perspective view illustrating a developing unit and a terminal holding member included in an image forming apparatus according to a second embodiment of the present invention.

As illustrated in FIG. 11, in the second embodiment, the opening 120 being an example of the main body-side fitter is a circular hole, and is open in the attaching direction of the developing unit 34. On the other hand, the protrusion 74 being an example of the unit-side fitter includes the base end 78 shaped in a cylindrical form. When the protrusion 74 and the opening 120 are fitted to each other, the base end 78 is used as a restrictor abutting against the opening 120 to position and fix the terminal holding member 104 in the up-down direction and the left-right direction with respect to the developing unit 34. The tip end 76 of the protrusion 74 has a tapered shape, which is gradually thinner toward the rear, and is used as a guide slope that guides the terminal holding member 104 in the direction approaching the developing unit 34 while an inclined surface formed on the upper surface of the tip end 76 slides with respect to an upper edge of the opening 120.

In the second embodiment, a detent that restricts the terminal holding member 104 from pivoting with respect to the developing unit 34 is provided. Specifically, at a lower portion of the rear end surface of the development housing 60, a second protrusion 80 protruding rearward is provided side by side with the protrusion 74. Similar to the protrusion 74, the second protrusion 80 includes a base end 84 shaped in a cylindrical form, and a tip end 82 having a tapered shape that is gradually thinner toward the rear. On the other hand, a second opening 122 is formed in the wall 118 of the terminal holding member 104 at a position corresponding to the second protrusion 80. The second opening 122 has a long hole shape that is long in the left-right direction. The second protrusion 80 and the second opening 122 are fitted to each other in accordance with the operation for attaching the developing unit 34, and if being fitted to each other, function as a detent.

Also in the second embodiment, the operation and effect similar to that of the first embodiment is obtained, and the positioning of the unit-side terminals 70 and the main body-side terminals 108 in the contact direction, which is likely to be unstable, can be ensured by the fitting of the protrusion 74 and the opening 120, and thus, it is possible to appropriately prevent poor contact between the unit-side terminals 70 and the main body-side terminals 108. In addition, the position of the terminal holding member 104 with respect to the developing unit 34 is determined by the circular shapes, and thus, it is possible to provide high positional accuracy.

Third Embodiment

Subsequently, the image forming apparatus 10 according to a third embodiment of the present invention will be described. In the third embodiment, the configurations of the unit-side fitter and the main body-side fitter are different from those of the above-described first embodiment.

Figure 12:
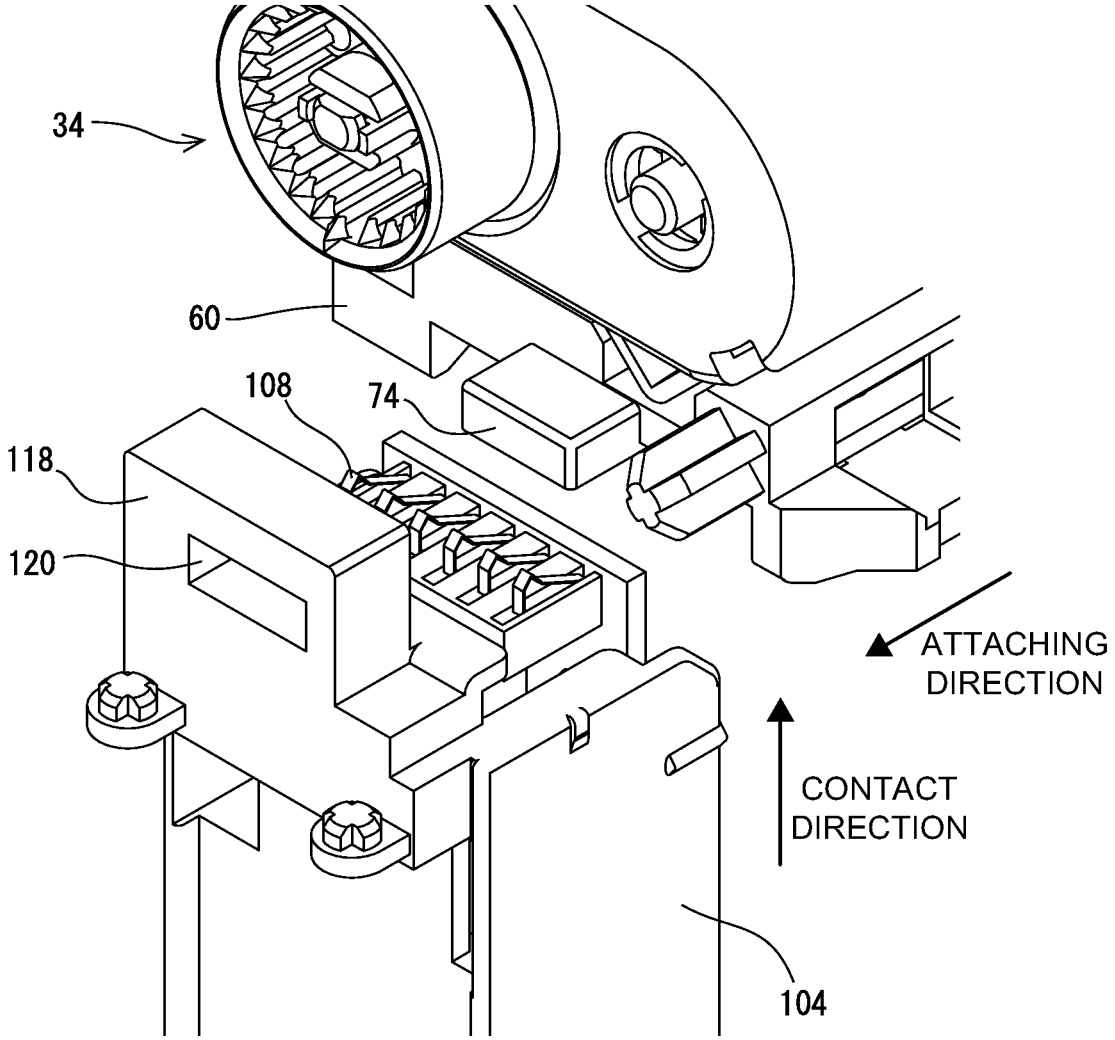
FIG. 12 is a perspective view illustrating a developing unit and a terminal holding member included in an image forming apparatus according to a third embodiment of the present invention.
Figure 13:
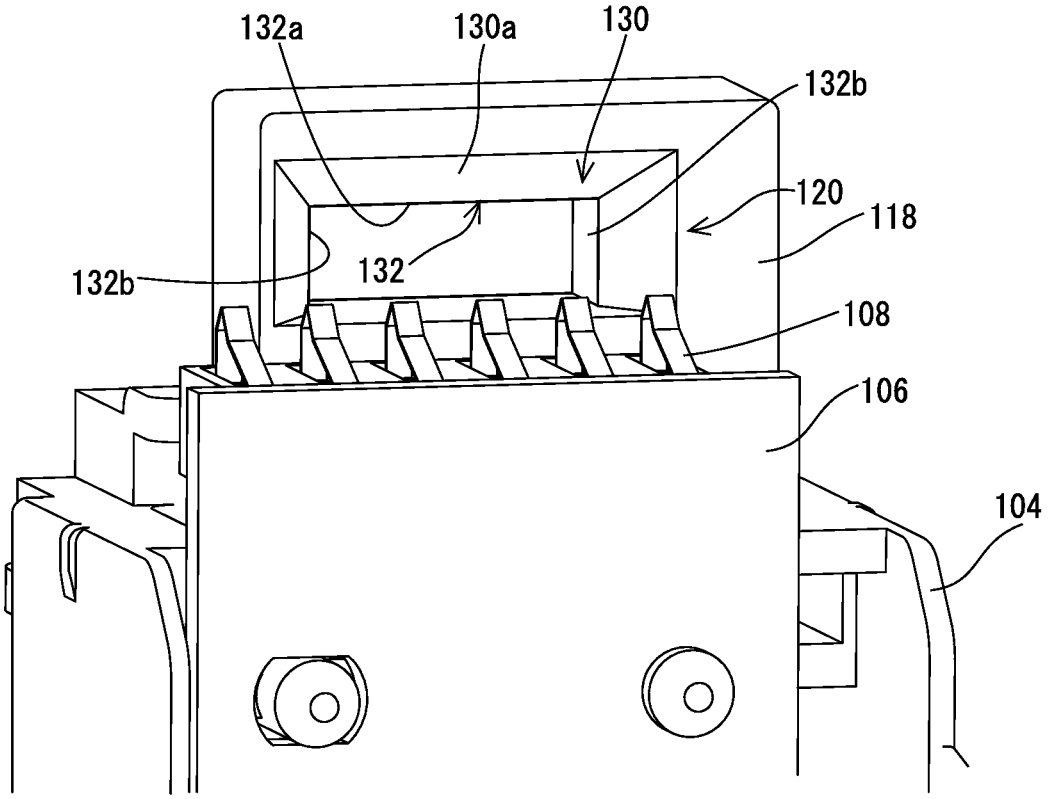
FIG. 13 is a perspective view illustrating a front surface side of the terminal holding member of the third embodiment.

As illustrated in FIGS. 12 and 13, in the third embodiment, the protrusion 74 being an example of the unit-side fitter has a rectangular parallelepiped shape. On the other hand, the opening 120 being an example of the main body-side fitter includes a guide slope 130*a* at a front side portion 130 of the opening 120 in the attaching direction of the developing unit 34, and includes restrictors 132*a* and 132*b* at a rear side portion 132 of the opening 120.

Specifically, the opening 120 has a rectangular opening at the rear side portion 132, and has a tapered opening gradually decreasing toward the rear at the front side portion 130. In other words, the upper edge (top surface) of the front side portion 130 of the opening 120 is an inclined surface closer to the lower edge toward the rear, and the guide slope 130*a* is formed on the front side portion 130. The guide slope 130*a* is a portion that guides the terminal holding member 104 in the direction approaching the developing unit 34 while sliding with respect to the upper surface of the protrusion 74. The right edge and the left edge of the front side portion 130 of the opening 120 are inclined surfaces being inclined in a direction approaching each other toward the rear. This makes it easy to fit the protrusion 74 into the opening 120.

The upper edge of the rear side portion 132 of the opening 120 is a flat surface extending in the horizontal direction, and the first restrictor 132*a* is formed on the upper edge. The first restrictor 132*a* is a portion that positions and fixes the terminal holding member 104 with respect to the developing unit 34 in the up-down direction if the first restrictor 132*a* abuts against the upper surface of the protrusion 74. The right edge and the left edge of the rear side portion 132 of the opening 120 are flat surfaces extending in the vertical direction, and the second restrictors 132*b* are formed on the right edge and the left edge. The second restrictors 132*b* are a portion that positions and fixes the terminal holding member 104 in the left-right direction with respect to the developing unit 34 if the second restrictors 132*b* abut against each of the right surface and the left surface of the protrusion 74.

Also in the third embodiment, the operation and effect similar to that of the first embodiment is obtained, and the positioning of the unit-side terminals 70 and the main body-side terminals 108 in the contact direction, which is likely to be unstable, can be ensured by the fitting of the protrusion 74 and the opening 120, and thus, it is possible to appropriately prevent poor contact between the unit-side terminals 70 and the main body-side terminals 108. In addition, forming an inclined surface such as the guide slope 130*a* in the opening 120 of the terminal holding member 104 makes it possible to make the inclined surface large, so that a margin for positional variation when the developing unit 34 is attached can be provided.

Fourth Embodiment

Subsequently, the image forming apparatus 10 according to a fourth embodiment of the present invention will be described. In the first embodiment, the unit-side terminals 70 are arranged on the lower surface of the outer side surfaces in the attaching direction of the developing unit 34. By contrast, the fourth embodiment differs from the above-described first embodiment in that unit-side terminal 70 are arranged on a right side surface of the developing unit 34, and the terminal holding member 104 is brought closer to the developing unit 34 from the right.

Figure 14:
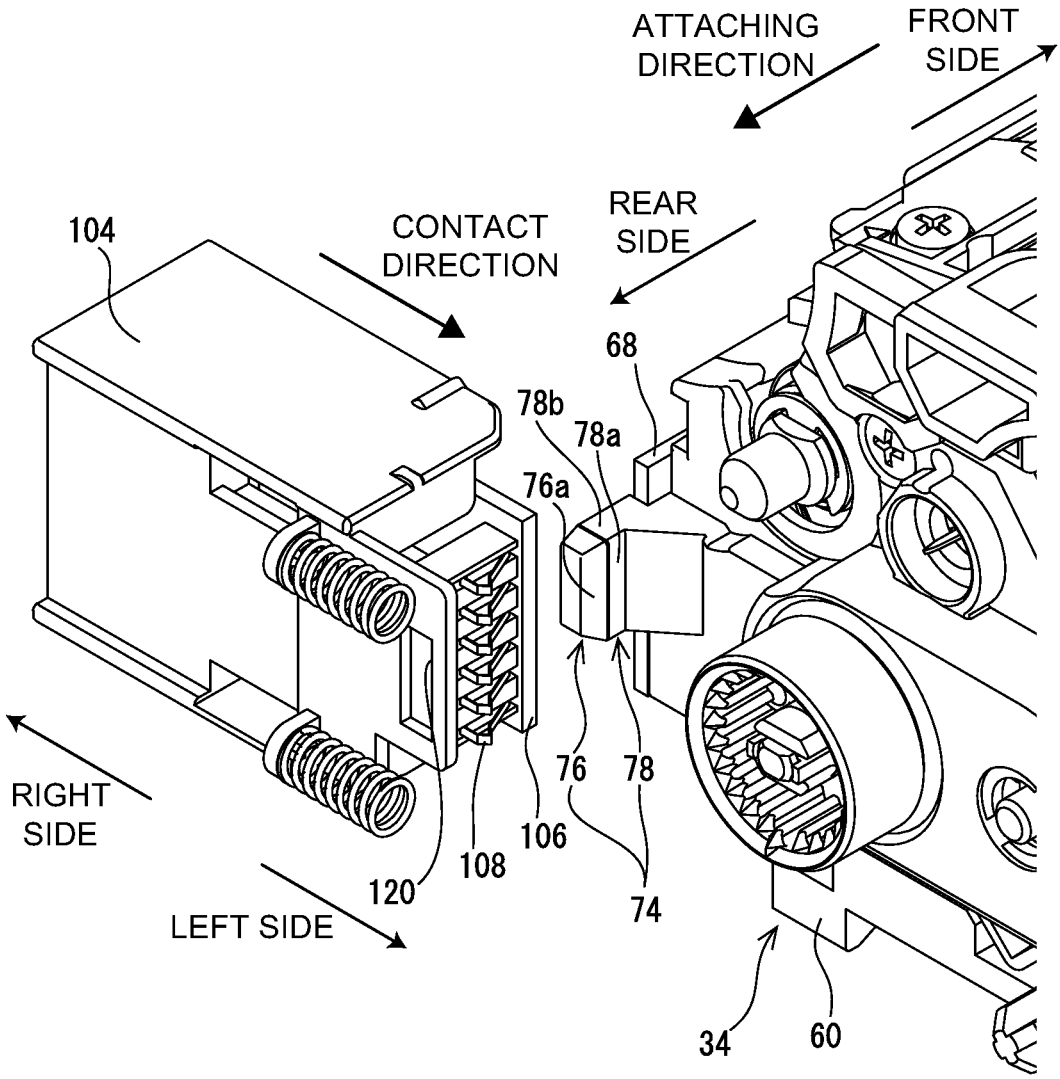
FIG. 14 is a perspective view illustrating a developing unit and a terminal holding member included in an image forming apparatus according to a fourth embodiment of the present invention.
Figure 15:
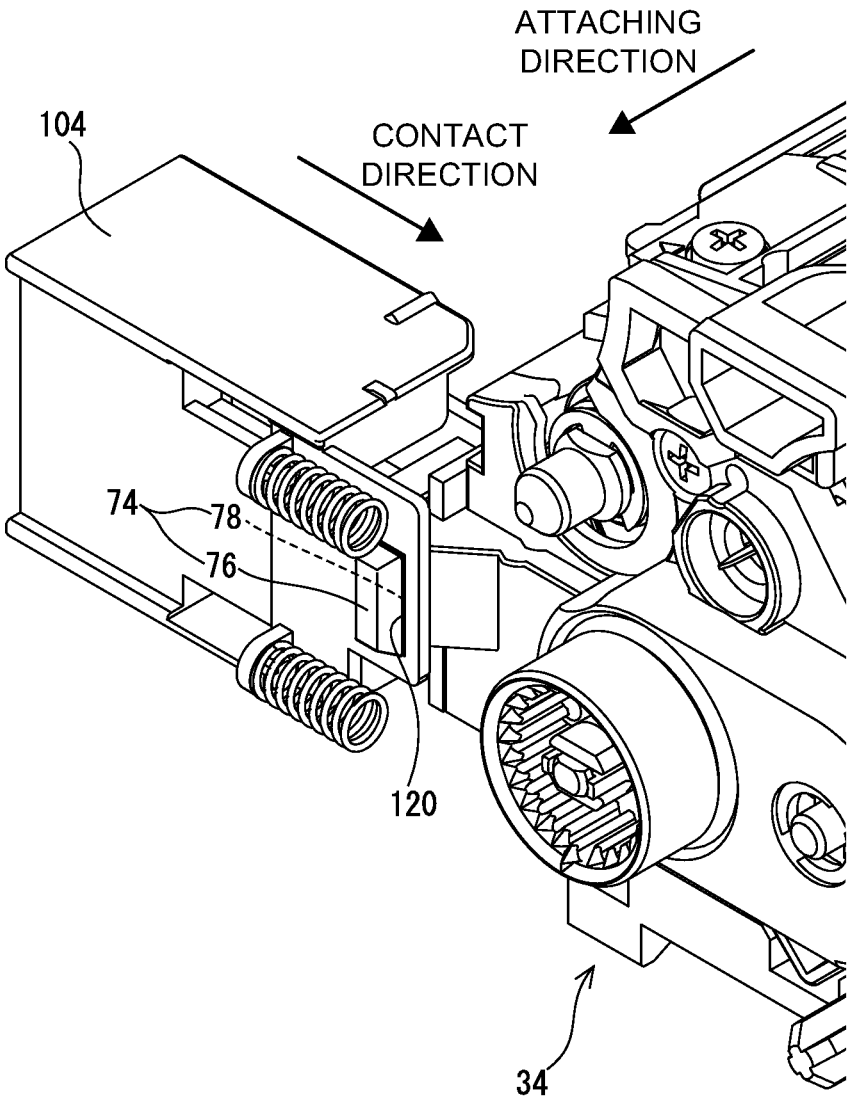
FIG. 15 is a perspective view illustrating a state when the attaching of the developing unit of the fourth embodiment is completed.

As illustrated in FIGS. 14 and 15, in the fourth embodiment, the substrate 68 is provided on the right side surface of the development housing 60, and the unit-side terminals 70 are provided on the right side surface of the substrate 68 (thus the right side of the developing unit 34) to be exposed. On the other hand, the holding member accommodator 102 is formed on the right side of the rear end of the developing unit accommodator 100, and the terminal holding member 104 is provided in the holding member accommodator 102 to be movable in the left-right direction (which is an example of a predetermined direction intersecting with the attaching direction of the developing unit 34). The main body-side terminals 108 are provided to protrude from the left side surface of the terminal holding member 104, and is held in a state of being positioned by the terminal holding member 104.

The terminal holding member 104 includes the rectangular plate-shaped wall 118 protruding leftward at a rear end of the left side surface of the terminal holding member 104, and the rectangular opening 120 being an example of the main body-side fitter is formed in the wall 118.

On the other hand, the developing unit 34 is formed with the protrusion 74 being an example of the unit-side fitter. In the fourth embodiment, the protrusion 74 is formed on the right side of the rear end surface of the development housing 60 to project rearward. The protrusion 74 includes the guide slope 76*a* at the tip end 76 of the protrusion 74, and the restrictors 78*a* and 78*b* at the base end 78 of the protrusion 74. Specifically, the left side surface of the tip end 76 of the protrusion 74 is an inclined surface closer to the right side surface toward the rear, and the guide slope 76*a* is formed on the left side surface. The guide slope 76*a* guides the terminal holding member 104 leftward, that is, in the direction approaching the developing unit 34 while sliding with respect to the left edge of the opening 120.

The left side surface of the base end 78 of the protrusion 74 is a flat surface extending in the vertical direction, and the first restrictor 78*a* is formed on the left side surface. The first restrictor 78*a* positions and fixes the terminal holding member 104 with respect to the developing unit 34 in the left-right direction (in the contact direction between the unit-side terminal 70 and the main body-side terminal 108) if the first restrictor 78*a* abuts against the upper edge of the opening 120 when the protrusion 74 and the opening 120 are fitted to each other. The upper surface and the lower surface of the base end 78 of the protrusion 74 are flat surfaces extending in the horizontal direction, and the second restrictors 78*b* are formed on the upper surface and the lower surface. The second restrictors 78*b* position and fix the terminal holding member 104 in the up-down direction with respect to the developing unit 34 if the second restrictors 78*b* abut against each of the upper edge and the lower edge of the opening 120.

In the fourth embodiment, the terminal holding member 104 and the main body-side terminals 108 are pulled leftward, that is, move in the direction approaching the developing unit 34, in accordance with the fitting operation of the protrusion 74 and the opening 120. Then, if the base end 78 of the protrusion 74 fits into the opening 120, the terminal holding member 104 and the main body-side terminals 108 are positioned and fixed in the left-right direction and the up-down direction with respect to the developing unit 34 in a state where the unit-side terminals 70 and the main body-side terminals 108 contact each other with a predetermined pressure.

Also in the fourth embodiment, the operation and effect similar to that of the first embodiment is obtained, and the positioning of the unit-side terminals 70 and the main body-side terminals 108 in the contact direction, which is likely to be unstable, can be ensured by the fitting of the protrusion 74 and the opening 120, and thus, it is possible to appropriately prevent poor contact between the unit-side terminals 70 and the main body-side terminals 108.

In addition, according to the fourth embodiment, the main body-side terminals 108 are provided sideways, and thus, it is difficult for dirt (dust, developing agent, etc.) from above to adhere to the main body-side terminals 108 to more reliably prevent poor contact between the unit-side terminals 70 and the main body-side terminals 108.

Fifth Embodiment

Subsequently, the image forming apparatus 10 according to a fifth embodiment of the present invention will be described. The fifth embodiment differs from the above-described first embodiment in that unit-side terminals 70 are arranged on the upper surface of the developing unit 34 and the terminal holding member 104 is brought close to the developing unit 34 from above. The other parts are the same, and thus, the description duplicated with the above-described first embodiment will be omitted or simplified.

Figure 16:
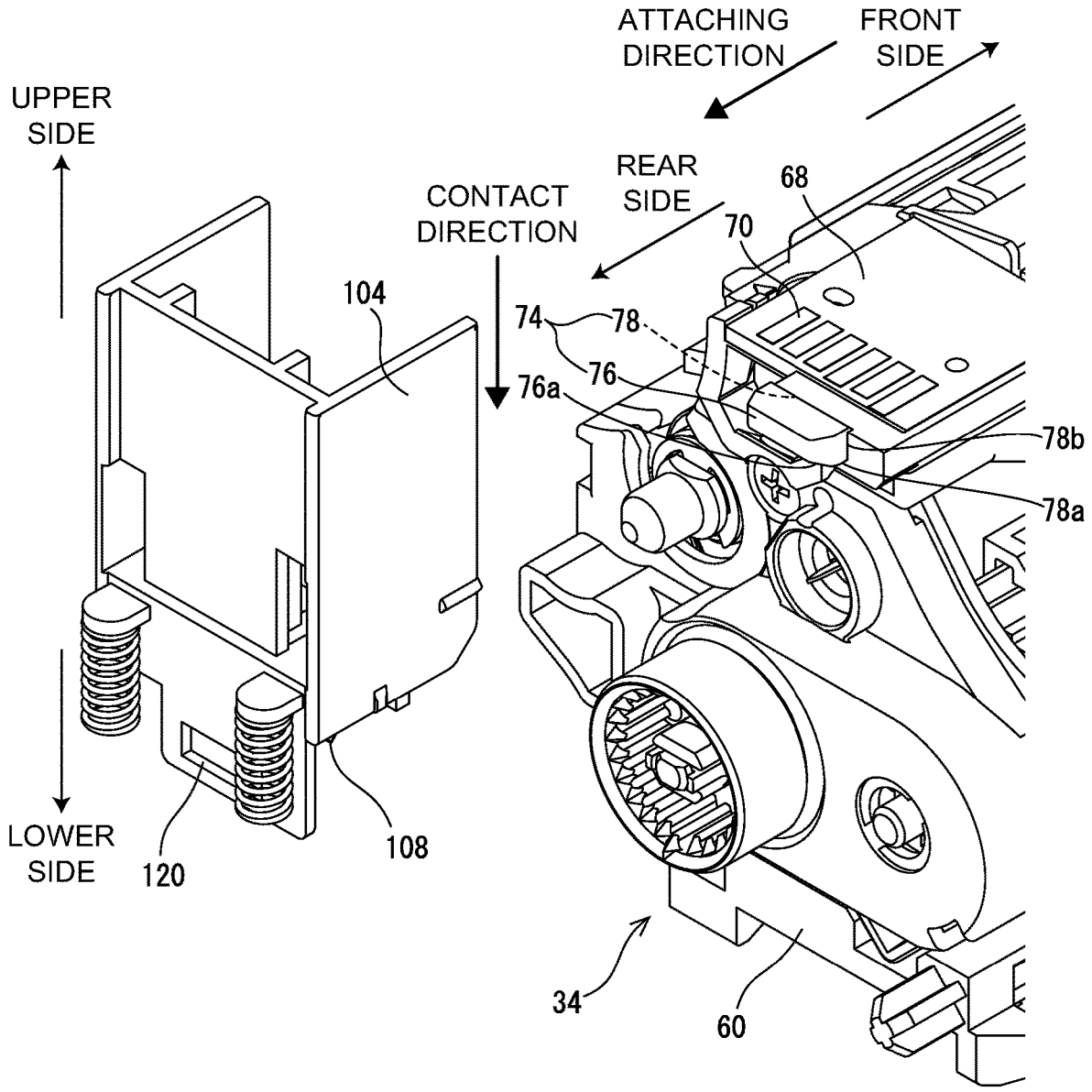
FIG. 16 is a perspective view illustrating a developing unit and a terminal holding member included in an image forming apparatus according to a fifth embodiment of the present invention.
Figure 17:
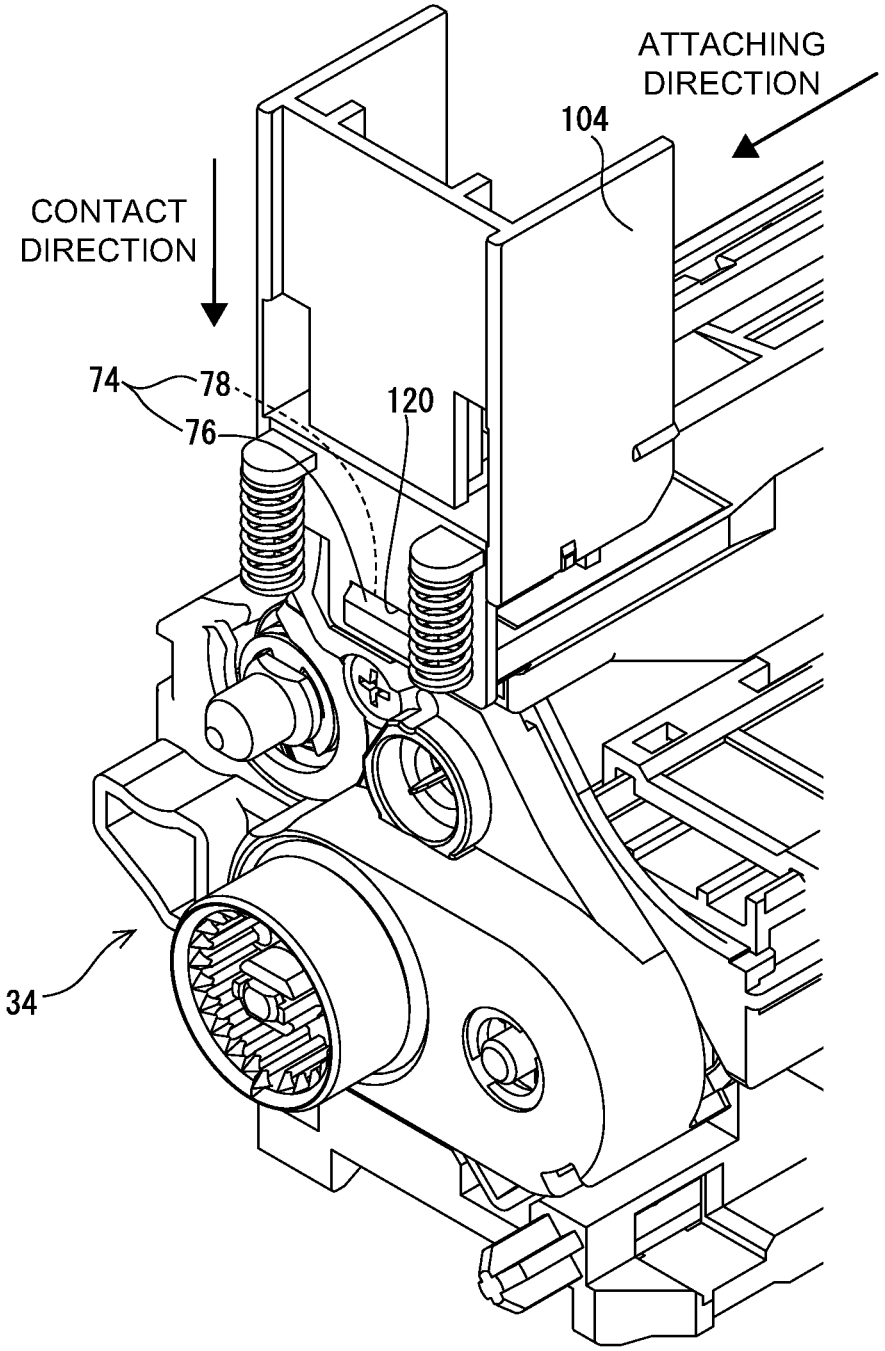
FIG. 17 is a perspective view illustrating a state when the attaching of the developing unit of the fifth embodiment is completed.

As illustrated in FIGS. 16 and 17, in the fifth embodiment, the substrate 68 is provided on the upper surface of the development housing 60, and the unit-side terminals 70 are provided on the upper surface of the substrate 68 (thus the upper surface of the developing unit 34) to be exposed. On the other hand, the holding member accommodator 102 is formed on the upper side (top surface side) of the rear end of the developing unit accommodator 100, and the terminal holding member 104 is provided in the holding member accommodator 102 to be movable in the up-down direction (which is an example of a predetermined direction intersecting with the attaching direction of the developing unit 34). The main body-side terminals 108 are provided to protrude from the lower surface of the terminal holding member 104, and is held in a state of being positioned by the terminal holding member 104.

The terminal holding member 104 includes the rectangular plate-shaped wall 118 protruding downward at a rear end of the lower surface of the terminal holding member 104, and the rectangular opening 120 being an example of the main body-side fitter is formed in the wall 118.

On the other hand, the developing unit 34 is formed with the protrusion 74 being an example of the unit-side fitter. In the fifth embodiment, the protrusion 74 is formed on the upper end of the rear end surface of the development housing 60 to project rearward. The protrusion 74 includes the guide slope 76*a* at the tip end 76 of the protrusion 74, and the restrictors 78*a* and 78*b* at the base end 78 of the protrusion 74. In other words, the lower surface of the tip end 76 of the protrusion 74 is an inclined surface closer to the upper surface toward the rear, and the guide slope 76*a* is formed on the lower surface. The guide slope 76*a* guides the terminal holding member 104 downward, that is, in the direction approaching the developing unit 34 while sliding with respect to the lower edge (bottom surface) of the opening 120.

The lower surface of the base end 78 of the protrusion 74 is a flat surface extending in the horizontal direction, and the first restrictor 78*a* is formed on the lower surface. The first restrictor 78*a* positions and fixes the terminal holding member 104 with respect to the developing unit 34 in the up-down direction (in the contact direction between the unit-side terminal 70 and the main body-side terminal 108) if the first restrictor 78*a* abuts against the lower edge of the opening 120 when the protrusion 74 and the opening 120 are fitted to each other. The right surface and the left surface of the base end 78 of the protrusion 74 are flat surfaces extending in the vertical direction, and the second restrictors 78*b* are formed on the right surface and the left surface. The second restrictors 78*b* position and fix the terminal holding member 104 in the left-right direction with respect to the developing unit 34 if the second restrictors 78*b* abut against each of the right edge and the left edge of the opening 120.

In the fifth embodiment, the terminal holding member 104 and the main body-side terminals 108 are pulled downward, that is, move in the direction approaching the developing unit 34, in accordance with the fitting operation of the protrusion 74 and the opening 120. Then, if the base end 78 of the protrusion 74 fits into the opening 120, the terminal holding member 104 and the main body-side terminals 108 are positioned and fixed in the left-right direction and the up-down direction with respect to the developing unit 34 in a state where the unit-side terminals 70 and the main body-side terminals 108 contact each other with a predetermined pressure.

Also in the fifth embodiment, the operation and effect similar to that of the first embodiment is obtained, and the positioning of the unit-side terminals 70 and the main body-side terminals 108 in the contact direction, which is likely to be unstable, can be ensured by the fitting of the protrusion 74 and the opening 120, and thus, it is possible to appropriately prevent poor contact between the unit-side terminals 70 and the main body-side terminals 108.

In addition, according to the fifth embodiment, the main body-side terminals 108 are provided downward, and thus, it is more difficult for dirt from above to adhere to the main body-side terminals 108 to more reliably prevent poor contact between the unit-side terminals 70 and the main body-side terminals 108. The main body-side terminals 108 are arranged on the top surface side of the developing unit accommodator 100, and thus, the main body-side terminals 108 is difficult for a user to see. Therefore, it is possible to prevent a user from inadvertently touching the main body-side terminals 108, to prevent oil and fat from adhering to the main body-side terminals 108, and to appropriately prevent poor contact between the terminals.

It is noted that in each of the above-described embodiments, the image forming apparatus 10 is exemplified by a multifunction peripheral including a copying machine, a facsimile, a printer, and the like, but the image forming apparatus 10 may be any one of a copying machine, a facsimile, a printer, and the like, or may include a combination of at least two of a copying machine, a facsimile, a printer, and the like. The image forming apparatus 10 is not limited to being of electrophotographic type, but an inkjet type.

In each of the above-described embodiments, the developing unit 34 is illustrated as the attaching and detaching unit, but the attaching and detaching unit may be a photoreceptor, a toner cartridge, or the like.

Furthermore, in each of the above-described embodiments, the unit-side fitter is the protrusion 74, and the main body-side fitter is the opening 120. However, the main body-side fitter may be a protrusion and the unit-side fitter may be an opening.

It is noted that the specific numerical values, component shapes, and the like described above are merely examples, and can be changed as necessary, depending on the product specifications, and the like. Each of the technical features described in each embodiment may be combined with each other and employed at the same time. For example, the fitter structure in the second embodiment or the third embodiment can be employed in the fourth embodiment or the fifth embodiment.

DESCRIPTION OF REFERENCE NUMERALS

10 Image forming apparatus
12 Apparatus main body
14 Image reading device
26 Image reader
30 Image former
34 Developing unit
36 Photoreceptor drum
66 Developing roller
70 Unit-side terminal
74 Protrusion (unit-side fitter)
76 Tip end of protrusion
**76*a*** Guide slope
78 Base end of protrusion (restrictor)
100 Developing unit accommodator
102 Holding member accommodator
104 Terminal holding member
108 Main body-side terminal
120 Opening (main body-side fitter)

What is claimed is:

1. An image forming apparatus comprising an attaching and detaching unit attachable to and detachable from an apparatus main body, the image forming apparatus comprising:

a unit-side terminal provided in the attaching and detaching unit;

a main body-side terminal that is provided in the apparatus main body and contacts the unit-side terminal when the attaching and detaching unit is attached to the apparatus main body;

a terminal holding member that is provided in the apparatus main body and holds the main body-side terminal;

a unit-side fitter provided in the attaching and detaching unit; and a main body-side fitter that is provided in the terminal holding member and is fitted to the unit-side fitter in accordance with an operation for attaching the attaching and detaching unit, wherein the terminal holding member is provided to be movable in a predetermined direction intersecting with an attaching direction of the attaching and detaching unit, and the unit-side fitter and the main body-side fitter are fitted to each other to move the terminal holding member in the predetermined direction and in a direction approaching the attaching and detaching unit so that the terminal holding member is positioned and fixed in at least the predetermined direction with respect to the attaching and detaching unit in a state where the unit-side terminal and the main body-side terminal contact each other.

2. The image forming apparatus according to claim 1, wherein the unit-side fitter and the main body-side fitter also position and fix the terminal holding member in a direction perpendicular to the predetermined direction with respect to the attaching and detaching unit in the state where the unit-side terminal and the main body-side terminal contact each other.

3. The image forming apparatus according to claim 1, wherein the unit-side fitter is a protrusion extending in the attaching direction of the attaching and detaching unit, and the main body-side fitter is an opening which is open in the attaching direction of the attaching and detaching unit and into which the protrusion is fitted.

4. The image forming apparatus according to claim 3, wherein the protrusion includes:

a guide slope that is formed on a rear side in the attaching direction of the attaching and detaching unit and guides the terminal holding member in a direction approaching the attaching and detaching unit while sliding with respect to the opening, and a restrictor that is formed on a front side in the attaching direction of the attaching and detaching unit with respect to the guide slope and positions and fixes the terminal holding member with respect to the attaching and detaching unit in at least the predetermined direction with the restrictor abutting against the opening.

5. The image forming apparatus according to claim 3, wherein the opening includes:

a guide slope that is formed on a front side in the attaching direction of the attaching and detaching unit and guides the terminal holding member in a direction approaching the attaching and detaching unit while sliding with respect to the protrusion; and a restrictor that is formed on a rear side in the attaching direction of the attaching and detaching unit with respect to the guide slope and positions and fixes the terminal holding member with respect to the attaching and detaching unit in at least the predetermined direction with the restrictor abutting against the protrusion.

6. The image forming apparatus according to claim 1, comprising a detent that restricts the terminal holding member from pivoting with respect to the attaching and detaching unit.

7. The image forming apparatus according to claim 1, comprising an urging member that is provided in the apparatus main body and urges the terminal holding member in the predetermined direction and in a direction away from the attaching and detaching unit.

* * * * *